United States Patent [19]

Hayakawa

[11] 4,381,656

[45] May 3, 1983

[54] AUTOMOBILE DOOR ASSEMBLY HAVING A DOOR LOCKING DEVICE

[75] Inventor: Hiroshi Hayakawa, Hiroshima, Japan

[73] Assignee: Toyo Kogyo Co., Ltd., Hiroshima, Japan

[21] Appl. No.: 211,226

[22] Filed: Nov. 28, 1980

[30] Foreign Application Priority Data

Nov. 30, 1979 [JP] Japan ..... 54-156042
Nov. 30, 1979 [JP] Japan ..... 54-156043

[51] Int. Cl.[3] ..... E05B 9/08

[52] U.S. Cl. ..... 70/451; 70/370; 292/DIG. 53

[58] Field of Search ..... 70/451, 370, 452, 466; 292/DIG. 53

[56] References Cited

U.S. PATENT DOCUMENTS 3,733,865 5/1973 Vorob ..... 70/451
4,099,397 7/1978 Davenbaugh ..... 70/451
4,139,998 2/1979 Jeavons ..... 70/370

*Primary Examiner*—Robert L. Wolfe
*Attorney, Agent, or Firm*—Fleit, Jacobson & Cohn

[57] ABSTRACT

An automobile door assembly having a door locking device wherein the door locking device can be installed only from the outside of the door outer panel. The door assembly includes a door outer panel having an outer and inner surfaces and formed with an attachment opening, a spring retainer adapted to be mounted on the door outer panel at the opening thereof, said spring retainer including a flange having a seat surface adapted to be seated on the outer surface of the door outer panel around the attachment opening and at least a pair of legs extending from said flange through the attachment opening beyond the inner surface of the door outer panel, each of said legs having a free end portion formed with a pawl, a retaining spring engaged with said pawls of the legs and being in contact with the inner surface of the door outer panel, a door locking device including a lock body inserted through the opening of the door outer panel and the spring retainer and engaged with the retaining spring to be held in position, said door locking device having a rotatable shaft which is connected through a connecting lever to a lock actuating member of a door locking mechanism, the connecting lever being removably connected at one end with the rotatable shaft of the door locking device. A method is also disclosed for installing a door lock device on the door outer panel.

6 Claims, 7 Drawing Figures

AUTOMOBILE DOOR ASSEMBLY HAVING A DOOR LOCKING DEVICE

The present invention relates to an automobile door and more particularly to a lock structure for an automobile door. More specifically, the present invention pertains to a mechanism for attaching a door locking device to an automobile door.

In conventional automobile doors, door locking devices have been installed on the door panels in an earlier stage of door assembling process. More specifically, a door panel assembly is at first installed on an automobile body and then assembled with a door locking mechanism having a lock actuating rod. Thereafter, a door locking device having a rotatable shaft is attached to the door outer panel by means of a retaining spring and the rotatable shaft of the door locking device is connected with the lock actuating rod of the door locking mechanism through a connecting lever. The door panel assembly is then attached with a window glass, a window regulator and other required parts, and finally the door inner panel is attached with trimming members. In this procedure, the installation of the door locking device is performed by inserting from outside the locking device to an opening formed in the door outer panel for the purpose, and attaching the retaining spring at the inside of the door outer panel. Further, the operations for connecting the rotatable shaft of the locking device with the lock actuating rod must be performed at the inner side of the door outer panel. Thus, in the conventional door structures, it has been absolutely required to put the inner trim members after the door locking device has been installed.

In the conventional type of door structures, inconveniencies have been encountered when it is required to install a preliminary assembled door to a body. More specifically, when an assembled door is to be installed on a body, care must be taken that the key for the locking device on the door is of the same number as the ignition key for the ignition switch which is installed on the body. However, it is a very troublesome work to locate a door having a key of a specific number and, even if such a door could be located, it would be inconvenient to convey the doors having specific key numbers in orders corresponding to the orders of the bodies having such specific key numbers.

It is therefore an object of the present invention to provide an automobile door which can be installed on a body without the above problems after the door has been assembled.

Another object of the present invention is to provide an automobile door assembly having a door locking mechanism which can be mounted in position only from the outside thereof.

According to the present invention, the above and other objects can be accomplished by an automobile door assembly comprising a door outer panel having an outer and inner surfaces and formed with an attachment opening, a spring retainer adapted to be mounted on the door outer panel at the opening thereof, said spring retainer including a flange having a seat surface adapted to be seated on the outer surface of the door outer panel around the attachment opening and at least a pair of legs extending from said flange through the attachment opening beyond the inner surface of the door outer panel, each of said legs having a free end portion formed with a pawl, a retaining spring engaged with said pawls of the legs and being in contact with the inner surface of the door outer panel, a door locking device including a lock body inserted through the opening of the door outer panel and the spring retainer and engaged with the retaining spring to be held in position, said door locking device having a rotatable shaft which is connected through a connecting lever to a lock actuating member of a door locking mechanism, means being provided between one end of the lever and the rotatable shaft of the door locking device for removably connecting them together. In a preferable aspect of the present invention, the other end of the connecting lever is connected with the lock actuating member through a clip which at one end slidably engages with the actuating rod. The lock actuating member is in the form of an L-shaped rod having vertically extending portion and a hooked end for connection with the connecting lever and the clip is slidably moved along the actuating rod together with the connecting lever so that, when the one end of the clip and the connecting lever have reached the hooked end of the actuating rod, the clip is turned and brought into engagement at the other end with the vertically extending portion of the actuating rod.

In this structure, the locking device can readily be installed on the outer door panel only from the outside of the outer door panel. For the purpose, the door may be assembled with the connecting lever engaged at one end with the vertical portion of the lock actuating rod and extending substantially horizontally through the opening in the door outer panel. The rotatable shaft of the door locking device is then attached with a vertically oriented position to the free end of the connecting lever. Thereafter, the door locking device is inserted into the opening of the door outer panel by being turned to a horizontally oriented position until the body thereof is fitted to the opening and held in position by the retaining spring. In this instance, the connecting lever is slidably moved along the lock actuating rod from the vertical portion to the hooked end portion and the lever is turned from the substantially horizontal position to a substantially vertical position as it reaches the hooked end portion of the actuating rod. The clip serves, when adopted, to hold the connecting lever in engagement with the hooked end portion of the lock actuating rod.

The above and other objects and features of the present invention will become apparent from the following descriptions of preferred embodiments taking reference to the accompanying drawings, in which.

Figure 1:
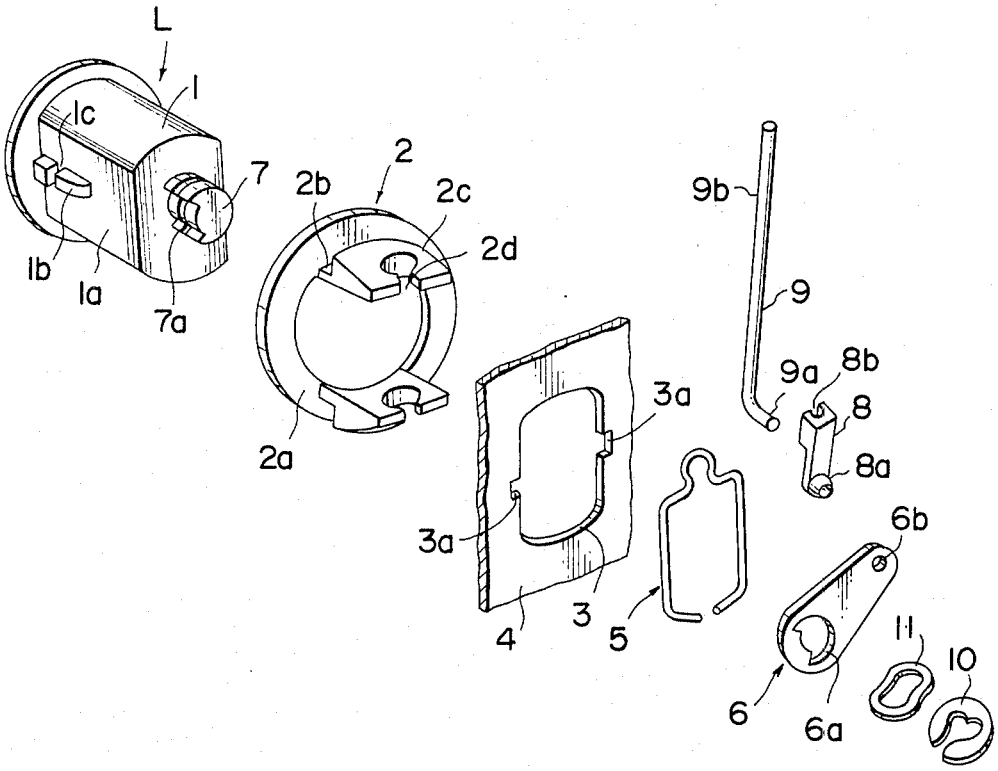
FIG. 1 is an explosed perspective view of the door locking mechanism in accordance with one embodiment of the present invention.

Referring now to the drawings, particularly to FIG. 1, there is shown a door locking device L having a lock body 1 and a rotatable shaft 7 which is adapted to be driven by a key (not shown). The door locking device L is adapted to be installed on a door outer panel 4 which is formed for the purpose with an attachment opening 3. The lock body 1 is of a configuration having a pair of flat side surfaces 1*a* respectively formed with longitudinally extending ridges 1*b*. The opening 3 is of a configuration substantially conforming with the cross-sectional configuration of the lock body 1 and formed with cutouts 3*a* at diametrically opposed positions for receiving the ridges 1*b* on the lock body 1. As shown in FIG. 1, the ridges 1*b* are respectively formed with grooves 1*c* for the purpose which will be described later.

Figure 2:
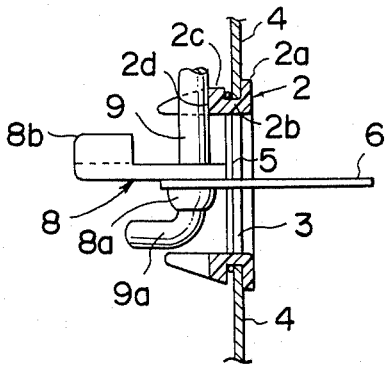
FIG. 2 is a vertical section showing the connecting lever ready for installing the door locking device.

The illustrated structure includes a spring retainer 2 which may be made of a resilient material such as a synthetic resin. The spring retainer 2 comprises an annular flange 2*a* and a pair of axially extending legs 2*b* formed at diametrically opposed positions. Each of the legs 2*b* has a free end formed with a pawl 2*c* which projects radially outwardly. As shown in FIG. 2, the legs 2*b* of the spring retainer 2 is inserted into the opening 3 in the door outer panel 4. A wire spring 5 which is shaped so as to conform with the cross-sectional contour of the lock body 1 is engaged with the pawls 2*c* of the legs 2*b* on the spring retainer 2 so that the spring retainer 2 and the spring 5 are held in position with the edge of the opening 3 of the door outer panel 4 between the flange 2*a* and the retaining spring 5. The lock body 1 is inserted into the spring retainer 2 until the grooves 1*c* in the ridges 1*b* are engaged with the spring 5 and held in position by the spring 5.

As in conventional automobile doors, there is provided a door locking mechanism having a substantially vertically extending lock actuating rod 9. The rod 9 includes a lower hooked end portion 9*a* and a vertically extending portion 9*b*. The rotatable shaft 7 of the door locking device L is connected through a connecting lever 6 with the lock actuating rod 9. More specifically, the shaft 7 is of a non-circular cross-sectional configuration and the connecting lever 6 is formed at one end with a correspondingly shaped hole 6*a* so that the lever 6 is connected to the shaft 7 by fitting the shaft 7 to the hole 6*a* of the lever 6. The shaft 7 is formed with a circumferential groove 7*a* and a retaining clip 10 is fitted thereto for holding the lever 6 in position. A waved washer 11 may be interposed between the retaining clip 10 and the lever 6.

Figure 4:
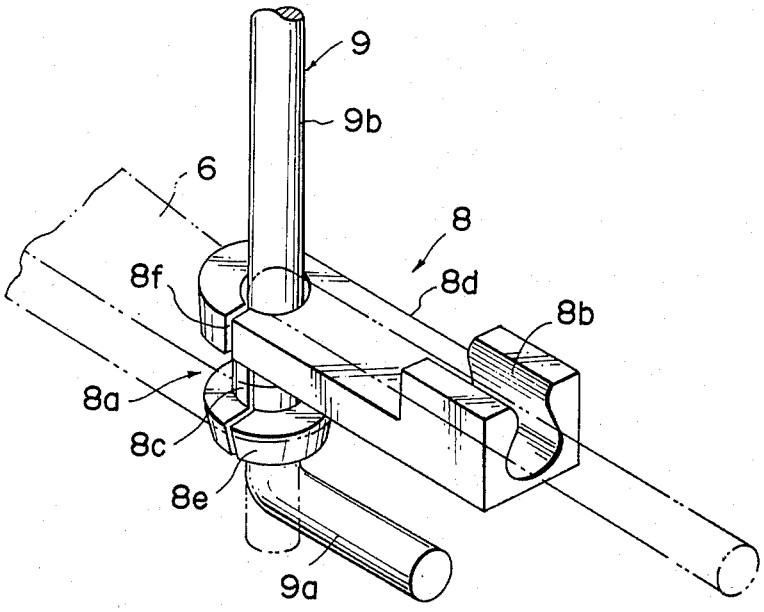
FIG. 4 is a fragmentary perspective view specifically showing the relative movement between the clip member and the lock actuating rod.

At the other end, the connecting lever 6 is formed with a hole 6*b* for engagement with the lock actuating rod 9. In the illustrated embodiment, there is provided an interconnecting clip 8 which has a body 8*d* formed at one end with a bearing portion 8*a* and at the other end with a clip portion 8*b*. As shown in FIG. 4, the bearing portion 8*a* extends substantially perpendicularly to the body 8*d* and includes a cylindrical portion 8*c* and a retaining collar 8*e*. The bearing portion 8*a* has an axially extending hole for passing the lock actuating rod 9 therethrough. Along the length of the bearing portion 8*a*, there are formed slits 8*f* which provide the bearing portion 8*a* with radial flexibility. The hole 6*b* of the connecting lever 6 is fitted to the cylindrical portion 8*c* of the bearing portion 8*a* before the actuating rod 9 is inserted into the hole of the bearing portion 8*a*. As shown in FIG. 4, the clip 8 is slidably movable along the rod 9 and, when the bearing portion 8*a* is moved from the vertical portion 9*b* to the hooked end portion 9*a*, the clip 8 is turned with respect to the rod 9 so that the clip portion 8*b* is engaged with the rod 9 as shown by phantom lines.

In installing the locking device L, the spring retainer 2 and the spring 5 are fitted to the door outer panel 4 as previously described. The connecting lever 6 is swingably connected to the bearing portion 8*a* of the clip 8 by fitting the hole 6*b* to the cylindrical portion 8*c* and then the bearing portion 8*a* of the clip 8 is engaged with the vertical portion 9*b* of the rod 9. In this position, the connecting lever 6 and the body 8*d* of the clip 8 are directed substantially horizontally and opposite to each other. The connecting lever 6 is positioned so that it extends outwardly through the opening 3 in the door outer panel 4. The body 8*d* of the clip 8 extends in the opposite direction with the clip portion 8*b* directed upwardly. The hooked end portion 9*a* of the actuating rod 9 is directed substantially in parallel with the clip 8. In order to hold the actuating rod 9 temporarily in position as shown in FIG. 2, the legs 2*b* of the spring retainer 2 are formed at the free ends with retaining grooves 2*d*. The door assembly may then be completed without installing the lock assembly L. Further, the door assembly may be installed on a car body.

Figure 3:
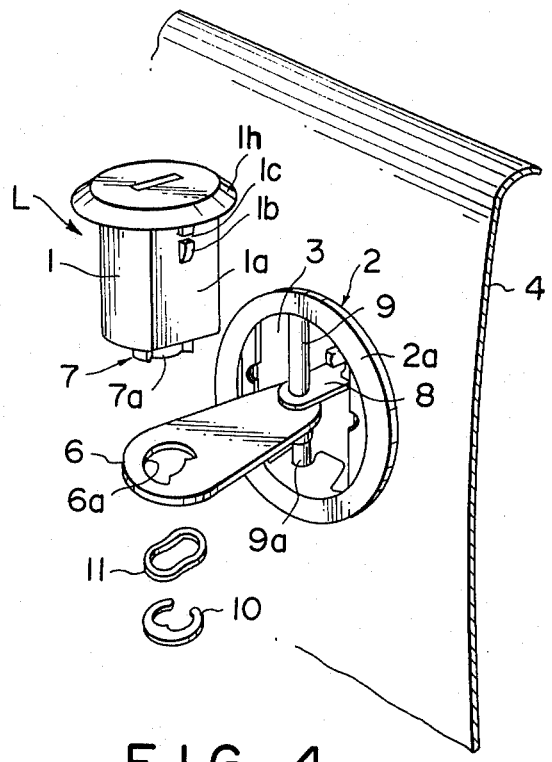
FIG. 3 is a perspective view showing the manner of installing the door locking device on the connecting lever.
Figure 5:
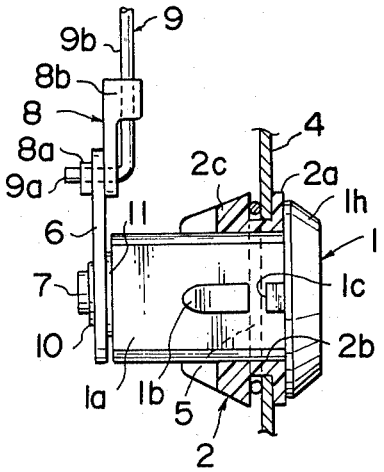
FIG. 5 is a vertical section showing the door locking device installed in position.

Thereafter, as shown in FIG. 3, the locking device L is attached to the connecting lever 6 by fitting the shaft 7 to the hole 6*a* in the lever 6 and putting the waved washer 11 and the retaining clip 10 in position. Then, the locking device L is forced into the spring retainer 2 so that the lock body 1 is fitted to the spring retainer 2 and firmly held in position by the spring 5 which now engages with the grooves 1*c* in the ridges 1*b* of the body 1. In this course of operation, the lock actuating rod 9 is detached from the retaining grooves 2*d* and the connecting lever 6 and the clip member 8 are slidably moved along the rod 9. As the lever 6 and the clip member 8 are moved from the vertical portion 9*b* to the hooked end portion 9*a*, they are turned from horizontal positions to vertical positions. More specifically, the connecting lever 6 is turned downwardly whereas the clip 8 is turned upwardly so that the clip portion 8*b* of the clip member 8 is brought into engagement with the vertical portion 9*b* of the rod 9 as shown in FIG. 5. Thus, the lever 6 is swingably connected through the clip member 8 with the hooked end portion 9*a* of the actuating rod 9. Therefore, the lock actuating rod 9 can be actuated by the rotatable shaft 7 which is in turn actuated by a suitable key.

Figure 6:
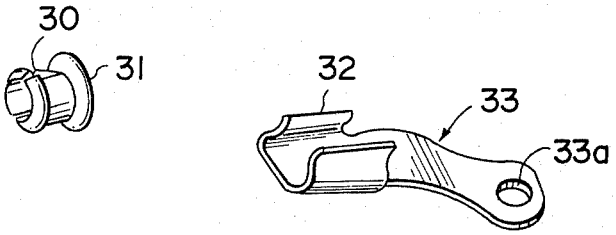
FIG. 6 is a perspective view showing the another form of the clip member; and, FIG. 7 is a sectional view similar to FIG. 5 but showing the embodiment using the clip member of FIG. 6.
Figure 7:
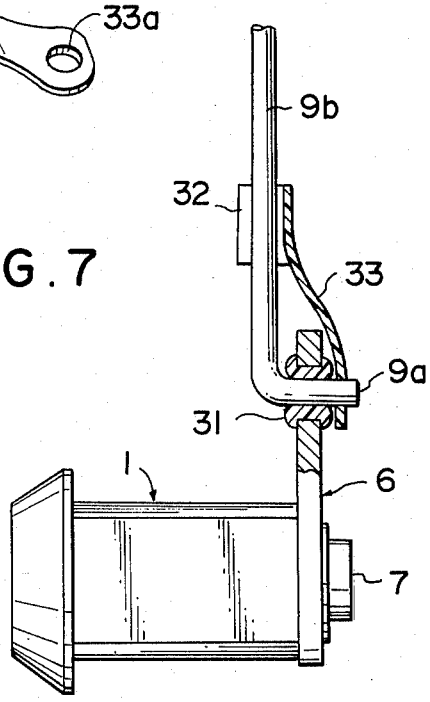

Referring now to FIGS. 6 and 7, the embodiment shown therein includes a clip member 33 having a clip portion 32 at one end. At the other end, the clip member 33 is formed with a hole 33*a* for slidable engagement with the actuating rod 9. The connecting lever 6 is engaged with the actuating rod 9 through a grommet 31 which has axially extending slits 30. The functions of the structure shown in FIGS. 6 and 7 are substantially the same as those shown in FIGS. 1 through 5.

The invention has thus been shown and described with reference to specific embodiments however, it should be noted that the invention is in no way limited to the details of the illustrated structures but changes and modifications may be made without departing from the scope of the appended claims.

I claim:

1. An automobile door assembly comprising:

a door outer panel having outer and inner surfaces and formed with an attachment opening;

a spring retainer adapted to be mounted on the door panel at the attachment opening thereof, said spring retainer including a central aperture, a flange having a seat surface adapted to be seated on the outer surface of the door panel around the attachment opening, and at least a pair of legs extending from said flange through the attachment opening beyond the inner surface of the door panel, each of said legs having a free end portion formed with a pawl;

a retaining spring engaged with said pawls of the legs and being in contact with the inner surface of the door panel;

a door locking device including a lock body inserted through the aperture in the spring retainer and engaged with the retaining spring to be held in position, a shaft rotatably mounted in said lock body, a connecting lever, and a lock actuating member;

first connecting means for removably connecting one end of the connecting lever to the rotatable shaft of the door locking device; and second connecting means for connecting said connecting lever and said lock actuating member.

2. An automobile door assembly in accordance with claim 1 in which said lock actuating member is comprised of a substantially L-shaped rod having a substantially vertically extending portion and a hooked end portion, and wherein said connecting lever is swingably connected by said second connecting means to the hooked end portion of the rod.

3. An automobile door in accordance with claim 2 wherein said second connecting means comprises a clip member having a clip portion detachably engaged with the vertically extending portion of the rod, said clip member having, opposite the clip portion, means for engaging the hooked end portion of the rod when the clip portion is engaged with the vertically extending portion to thereby constrain the other end of the connecting lever on the hooked end portion of the rod.

4. An automobile door in accordance with claim 3 in which said means for engaging the hooked end portion includes bearing means for swingably receiving said other end of the connecting lever.

5. An automobile door in accordance with claim 3 in which said means for engaging the hooked end portion of the rod comprises a grommet.

6. Method of assembling an automobile door comprising steps of providing a door outer panel having an attachment opening, inserting from outside of the door outer panel into said opening a spring retainer having a fitting hole therein, attaching a retaining spring to said spring retainer at inside of the door outer panel, connecting one end of a connecting lever to a lock actuating rod of a door locking mechanism, temporarily holding the connecting lever so that it extends outwardly through the fitting hole of the spring retainer, completing door assembling procedure except installation of a door locking device, connecting a rotatable shaft of the door locking device to the other end of the connecting lever, releasing the connecting lever, and forcing the door locking device into the fitting hole of the spring retainer until the door locking device is firmly engaged with the retaining spring simultaneously forcing the connecting lever to the inside of the door outer panel causing a turning movement thereof.

* * * * *